US011724924B2

(12) United States Patent
Figa

(10) Patent No.: US 11,724,924 B2
(45) Date of Patent: Aug. 15, 2023

(54) TWO-HANDLED ROTATING LID OPENER

(71) Applicant: Romek Figa, Hanover, MA (US)

(72) Inventor: Romek Figa, Hanover, MA (US)

( * ) Notice: Subject to any disclaimer, the term of this patent is extended or adjusted under 35 U.S.C. 154(b) by 525 days.

(21) Appl. No.: 16/831,207

(22) Filed: Mar. 26, 2020

(65) Prior Publication Data

US 2020/0331738 A1 Oct. 22, 2020

Related U.S. Application Data

(60) Provisional application No. 62/836,296, filed on Apr. 19, 2019.

(51) Int. Cl.
*B67B 7/18* (2006.01)

(52) U.S. Cl.
CPC ..... *B67B 7/18* (2013.01)

(58) Field of Classification Search
CPC ..... B67B 7/18; B67B 7/14; B67B 7/16; F16B 2/00; F16B 2/02; F16B 2/04; F16B 2/06; F16B 2/065; F16B 2/10; F16B 2/12; F16B 2/14; F16B 2/185
See application file for complete search history.

(56) References Cited

U.S. PATENT DOCUMENTS

| | | | | |
|---|---|---|---|---|
| 32,627 A | | 9/1868 | Munger | |
| 515,983 A | | 3/1894 | Winchester | |
| 630,734 A | | 8/1898 | Oothout | |
| 648,763 A | | 5/1900 | La Barge | |
| 710,606 A | | 10/1902 | Pagett | |
| 826,294 A | | 7/1906 | Waldschmidt | |
| 936,927 A | | 10/1909 | McCallum | |
| 1,111,998 A | * | 9/1914 | Duvall | B67B 7/18 81/98 |
| 1,227,738 A | | 5/1917 | Bellis et al. | |
| 1,394,388 A | | 10/1921 | Wisenberg et al. | |
| 1,424,607 A | | 8/1922 | Wisenberg | |
| 1,456,525 A | | 5/1923 | West | |
| 1,781,997 A | | 11/1930 | Berezowski | |
| 1,912,500 A | | 6/1933 | Rutledge | |
| 2,094,225 A | | 9/1937 | Tuttle | |
| 2,447,770 A | * | 8/1948 | Ratchford | B67B 7/18 81/3.43 |

(Continued)

FOREIGN PATENT DOCUMENTS

| | | | |
|---|---|---|---|
| GB | 2 227 968 | | 8/1990 |
| WO | WO 03/078295 | * | 9/2003 |

OTHER PUBLICATIONS

US 10,464,809 B2, 11/2019, Figa (withdrawn)

(Continued)

*Primary Examiner* — Robert J Scruggs
(74) *Attorney, Agent, or Firm* — Nutter McClennen Fish LLP

(57) ABSTRACT

A rotating lid opener having two opposing handles facilitates removal of a screw lid from a container (e.g., a jar), particularly when used with a separate container securing device to hold the container while the screw lid is being removed using the two-handled device. In certain embodiments, the two opposing handles are one-way foldable and include a locking mechanism to hold the handles in an open/extended position for operating the rotating lid opener to loosen a screw lid from a container.

18 Claims, 8 Drawing Sheets

(56) References Cited

U.S. PATENT DOCUMENTS

| | | | | |
|---|---|---|---|---|
| 2,524,434 | A * | 10/1950 | Duket | B67B 7/18 81/3.4 |
| 2,569,239 | A | 9/1951 | Holmen | |
| 2,732,740 | A | 1/1956 | Holmen | |
| 2,977,128 | A | 3/1961 | Judelshon | |
| 3,008,618 | A | 11/1961 | Watts et al. | |
| 3,891,171 | A | 6/1975 | Samuelian et al. | |
| 4,102,226 | A | 7/1978 | McGuire | |
| 4,222,577 | A | 9/1980 | Giffin | |
| 4,836,482 | A | 6/1989 | Sokol | |
| 5,129,715 | A | 7/1992 | Maynard, Jr. | |
| 5,209,142 | A | 5/1993 | Dickson | |
| 5,348,276 | A | 9/1994 | Blacker | |
| 5,450,690 | A | 9/1995 | Elsea | |
| 6,205,888 | B1 | 3/2001 | Laudani | |
| 6,425,305 | B2 | 7/2002 | Gasparre | |
| 6,679,138 | B2 * | 1/2004 | Battles | B67B 7/44 81/97 |
| D501,382 | S * | 2/2005 | Macauley | D8/18 |
| 7,100,473 | B2 | 9/2006 | Hefti et al. | |
| 7,395,775 | B2 | 7/2008 | LaScala | |
| 8,820,548 | B2 | 9/2014 | Wilson | |
| 9,120,208 | B2 * | 9/2015 | Johnson | B25B 15/04 |
| 2002/0185800 | A1 | 12/2002 | Duncan | |
| 2005/0229750 | A1 | 10/2005 | Duke | |
| 2006/0243098 | A1 * | 11/2006 | March | B67B 7/18 81/3.4 |
| 2011/0061497 | A1 | 3/2011 | Jedrzejewski et al. | |
| 2017/0283231 | A1 * | 10/2017 | Figa | B67B 7/18 |
| 2017/0284596 | A1 | 10/2017 | Figa | |
| 2020/0048062 | A1 | 2/2020 | Figa | |
| 2021/0087038 | A1 | 3/2021 | Figa | |

OTHER PUBLICATIONS

International Searching Authority/US, International Search Report and Written Opinion, Application No. PCT/US2017/023745, dated Jul. 7, 2019, 9 pages.

Kuhn Rikon, The Gripper Jar Opener, from kuhnrikonshop.com web site, web page dated Apr. 21, 2016, web page downloaded Aug. 29.

Unknown, Search Results for Jar Opener showing various types of jar openers, from wantitall.co.za web site, web page downloaded Aug. 29, 2020.

United States Patent and Trademark Office Non-Final Office Action for U.S. Appl. No. 17/014,529, dated May 26, 2022, 20 pages.

* cited by examiner

TWO-HANDLED ROTATING LID OPENER

CROSS-REFERENCE TO RELATED APPLICATION(S)

This patent application claims the benefit of U.S. Provisional Patent Application No. 62/836,296 entitled TWO-HANDLED ROTATING LID OPENER filed Apr. 19, 2019, which is hereby incorporated herein by reference in its entirety.

The subject matter of this patent application also may be related to U.S. patent application Ser. No. 15/296,479 entitled Apparatus and Method For Gripping a Container During Lid Opening filed Oct. 18, 2016 and published as U.S. Patent Application Publication No. US 2017/0283231 on Oct. 5, 2017 and to U.S. patent application Ser. No. 15/296,502 entitled Apparatus and Method For Gripping a Container For Lid Opening filed Oct. 18, 2016 and published as U.S. Patent Application Publication No. US 2017/0284596 on Oct. 5, 2017, each of which is hereby incorporated herein by reference in its entirety.

FIELD OF THE INVENTION

The invention generally relates to a device that facilitates removal of a screw lid from ajar.

BACKGROUND OF THE INVENTION

U.S. Pat. No. 7,100,473 entitled Rotating Cap Opener issued Sep. 5, 2006 to Heftitec SA discloses a device that facilitates removal of a screw lid from a container (e.g., a jar), specifically by allowing a user to secure the device onto the screw lid until three clamping jaws clamp down on the screw lid, and then, while holding the container with one hand, to use the device with the other hand to twist off the screw lid. The device includes a single elongated handle that allows the user to produce more torque for removing the screw lid. For some people, holding the jar with one hand might be difficult, possibly reducing the efficacy of the device in removing the screw lid. Also, holding the jar with one hand leaves only the other hand free to use the device to remove the screw lid, which may be difficult for some people.

SUMMARY OF VARIOUS EMBODIMENTS

In accordance with one embodiment, a rotating lid opener comprises a clamping assembly having at least one movable clamping jaw for clamping onto a screw lid of a container and also comprises a pair of opposing handles coupled to the clamping assembly to allow for two-handed use of the rotating lid opener while loosening the screw lid.

In various alternative embodiments, the clamping assembly may include exactly two movable clamping jaws, exactly three movable clamping jaws, and/or at least one movable clamping jaw and at least one stationary clamping jaw. The handles may be one-way foldable and may include a handling locking mechanism (e.g., a pin) to hold the foldable handles in an open/extended position for operating the rotating lid opener to loosen a screw lid from a container.

A kit may comprise any of the above-described rotating lid openers along with a container securing device, such as a device for gripping a container described in U.S. Patent Application Publication No. US 2017/0283231 or U.S. Patent Application Publication No. US 2017/0284596 or a rubber mat.

A system may comprise any of the above-described rotating lid openers along with a container securing device, such as a device for gripping a container described in U.S. Patent Application Publication No. US 2017/0283231 or U.S. Patent Application Publication No. US 2017/0284596 or a rubber mat.

Embodiments also may include a method for loosening a screw lid from a container comprising placing the container on or in a container securing device; placing a rotating lid opener according to any of the above-described embodiments on a screw lid of the container; tightening the rotating lid opener on the screw lid of the container; and using the two opposing handles of the rotating lid opener to loosen the screw lid.

Additional embodiments may be disclosed and claimed.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

It should be noted that the foregoing figures and the elements depicted therein are not necessarily drawn to consistent scale or to any scale. Unless the context otherwise suggests, like elements are indicated by like numerals.

DESCRIPTION OF ILLUSTRATIVE EMBODIMENTS

As discussed above, U.S. Pat. No. 7,100,473 entitled Rotating Cap Opener issued Sep. 5, 2006 to Heftitec SA discloses a device that facilitates removal of a screw lid from a container (e.g., a jar), specifically by allowing a user to secure the device onto the screw lid until three clamping jaws clamp down on the screw lid, and then, while holding the container with one hand, to use the device with the other hand to twist off the screw lid. The device includes a single elongated handle that allows the user to produce more torque for removing the screw lid. For some people, holding the container with one hand might be difficult, possibly reducing the efficacy of the device in removing the screw lid. Also, holding the container with one hand leaves only the other hand free to use the device to remove the screw lid, which may be difficult for some people.

Therefore, exemplary embodiments provide a two-handled device that facilitates removal of a screw lid from a container (e.g., a jar), particularly when used with a separate device (e.g., devices for gripping a container described in U.S. Patent Application Publication No. US 2017/0283231 or U.S. Patent Application Publication No. US 2017/0284596, or perhaps even a rubber mat on which the container is placed) to hold the container while the screw lid is being removed using the two-handled device. Certain exemplary embodiments use a mechanism similar to the one in U.S. Pat. No. 7,100,473 (which is hereby incorporated herein by reference in its entirety) to secure the device onto the screw lid, e.g., having at least one movable clamping jaw that can be tightened against the screw lid using a knob on the top of the device. However, by including two opposing handles rather than only one handle, the user can use both hands to operate the device to twist off the screw lid while optionally also pressing downward on the screw lid to further facilitate removal. With two opposing handles, the user can press down evenly and/or unevenly (e.g., rocking back and forth) before, during, and/or after twisting to facilitate loosening of the screw lid. Overall, the inventor expects the two-handled device to be much easier to use.

Figure 1:
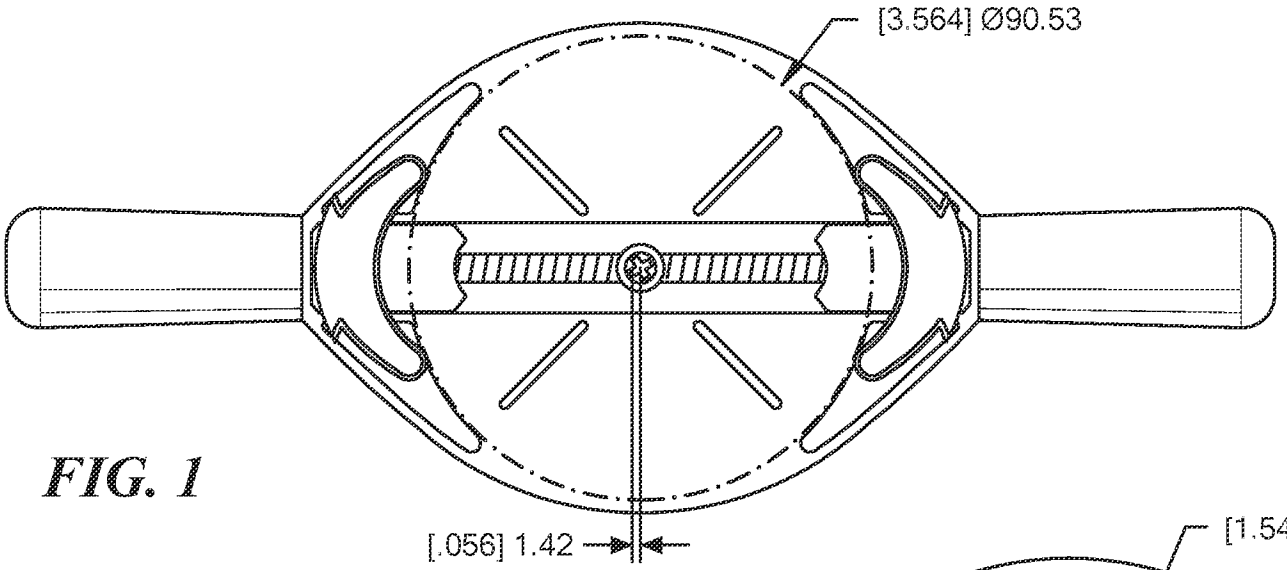
FIG. 1 is a schematic diagram showing a bottom view a first exemplary device showing the two opposing elongated handles relative to a central clamping assembly.

FIG. 1 is a schematic diagram showing a bottom view a first exemplary device showing the two opposing elongated handles relative to a central clamping assembly. In this exemplary embodiment, the clamping assembly includes two movable clamping jaws, although alternative embodiments may include one, two, or more movable clamping jaws and in some cases may include one or more stationary clamping jaws. In this figures, the two movable clamping jaws are shown at their most open position.

Figure 2:
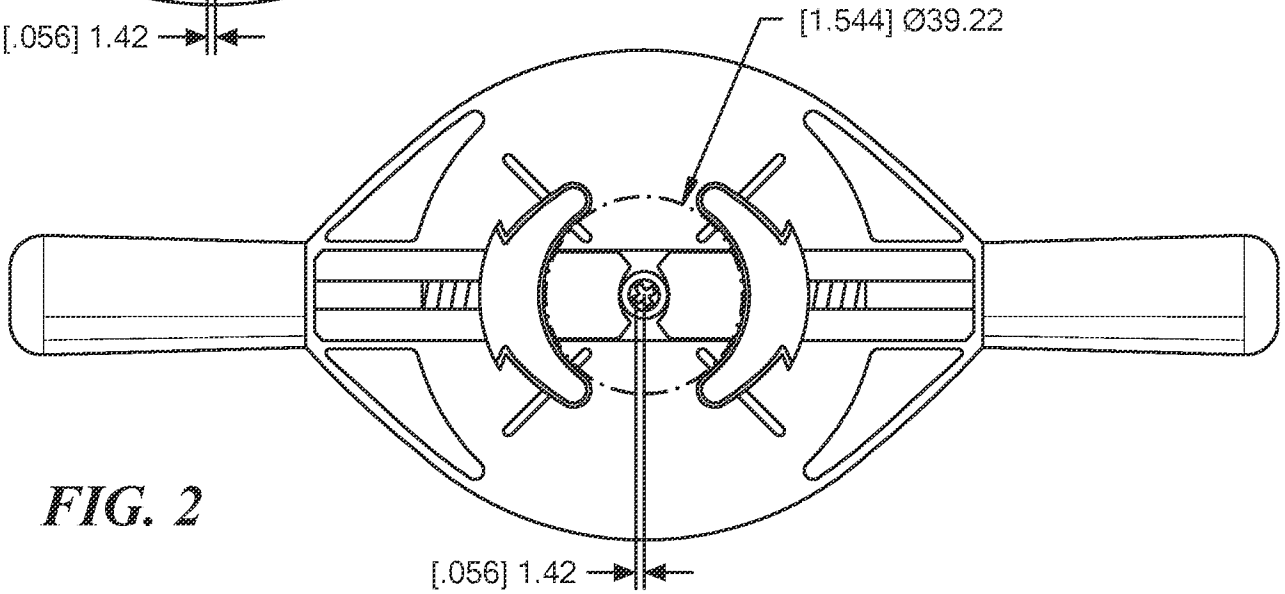
FIG. 2 is a schematic diagram showing a bottom view of the first exemplary device showing the two movable clamping jaws at their least open position.

FIG. 2 is a schematic diagram showing a bottom view of the first exemplary device showing the two movable clamping jaws at their least open position.

Figure 3:
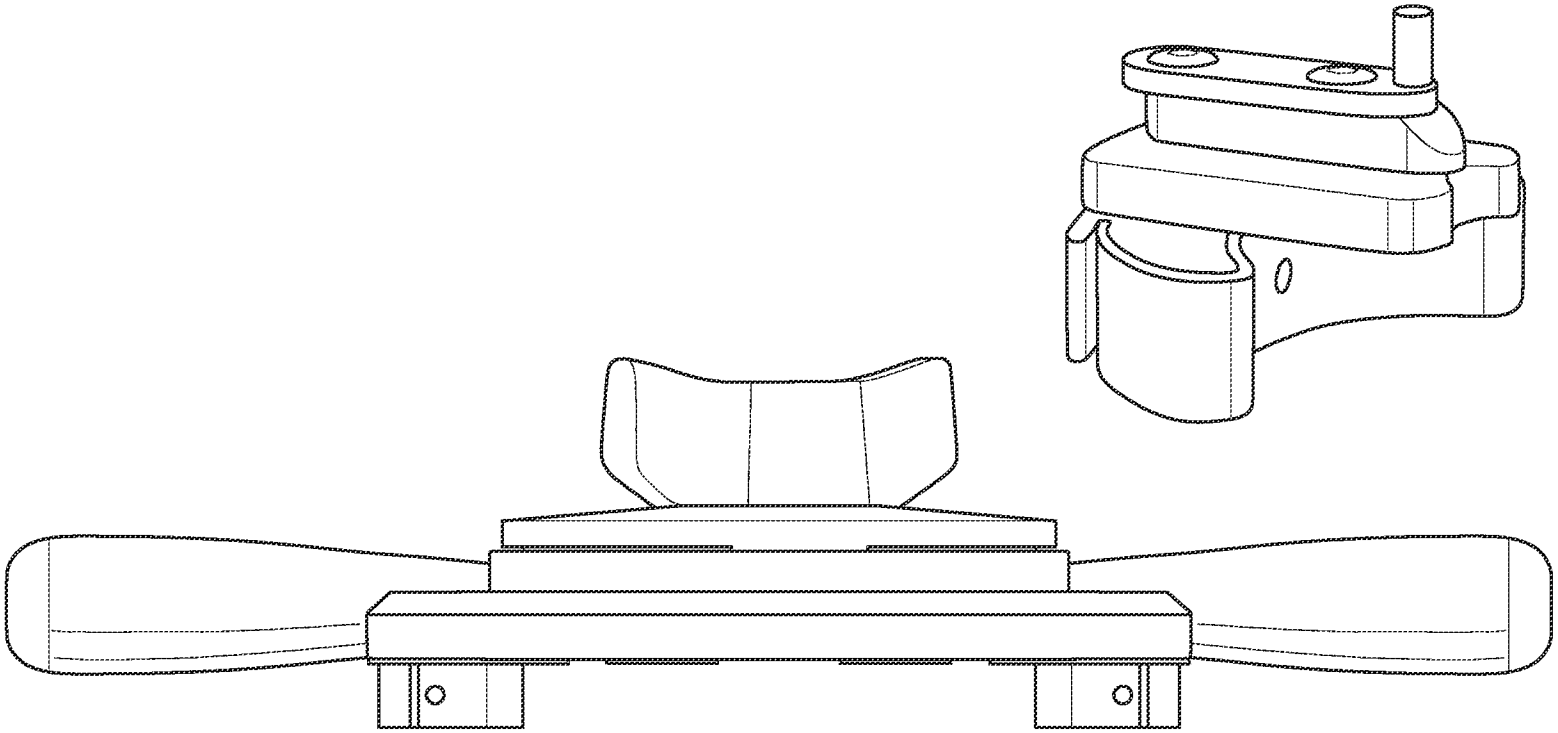
FIG. 3 is a schematic diagram showing a side view of the first exemplary device as well as a perspective view of a clamping jaw.

FIG. 3 is a schematic diagram showing a side view of the first exemplary device as well as a perspective view of a clamping jaw.

Figure 4:
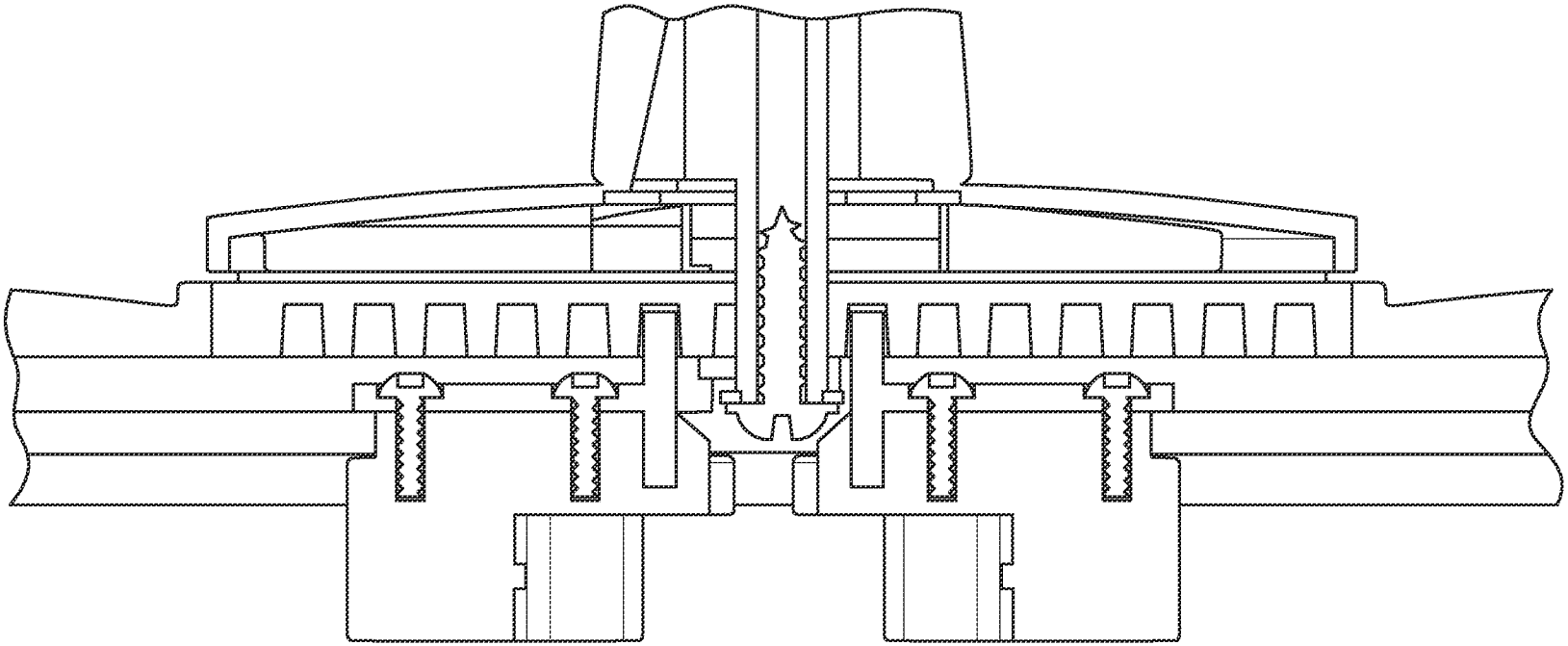
FIG. 4 is a schematic diagram showing a cross-sectional view of the clamping assembly of the first exemplary device.

FIG. 4 is a schematic diagram showing a cross-sectional view of the clamping assembly of the first exemplary device.

Figure 5:
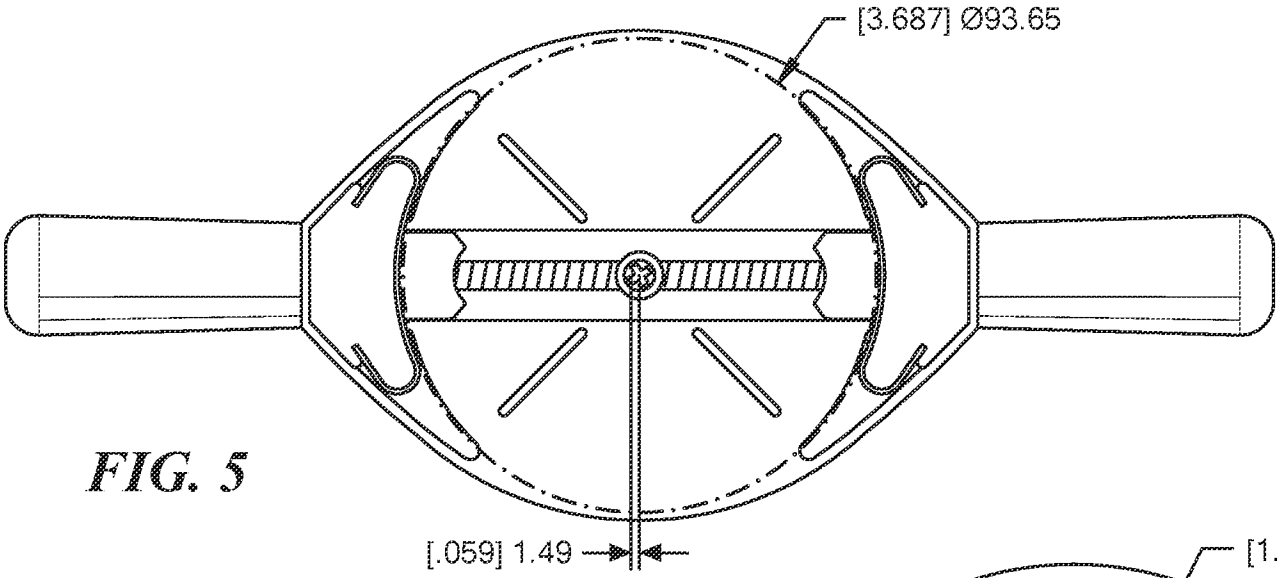
FIG. 5 is a schematic diagram showing a bottom view a second exemplary device showing the two opposing elongated handles relative to the central clamping assembly. In this figure, the two movable clamping jaws are shown at their most open position.

FIG. 5 is a schematic diagram showing a bottom view a second exemplary device showing the two opposing elongated handles relative to the central clamping assembly. In this figure, the two movable clamping jaws are shown at their most open position.

Figure 6:
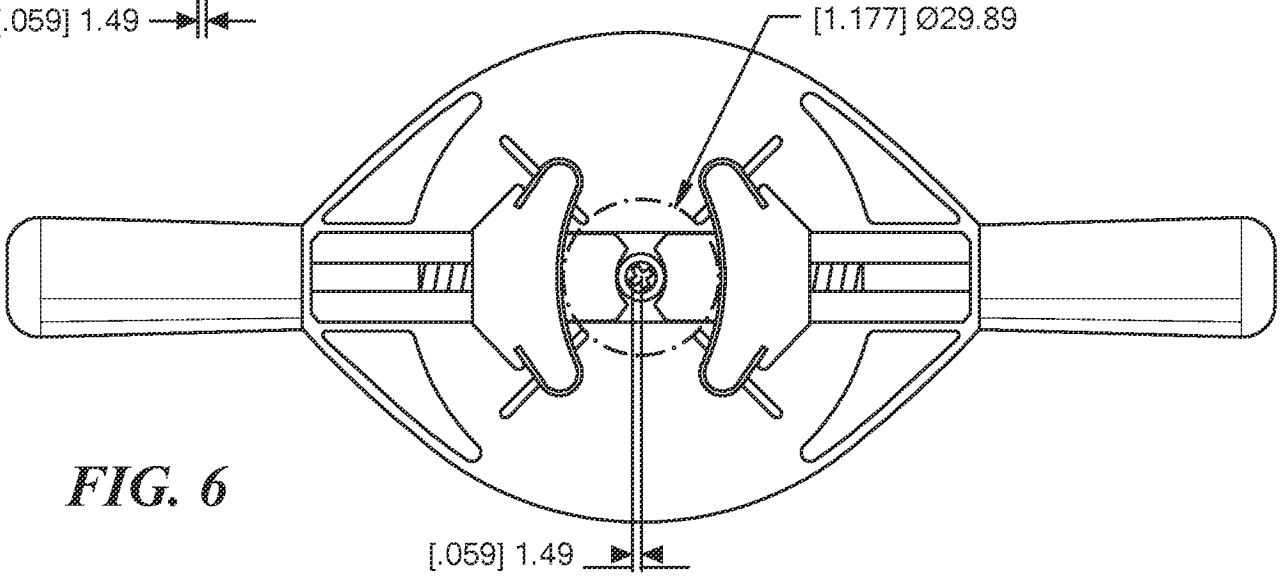
FIG. 6 is a schematic diagram showing a bottom view of the second exemplary device showing the two movable clamping jaws at their least open position.

FIG. 6 is a schematic diagram showing a bottom view of the second exemplary device showing the two movable clamping jaws at their least open position.

Figure 7:
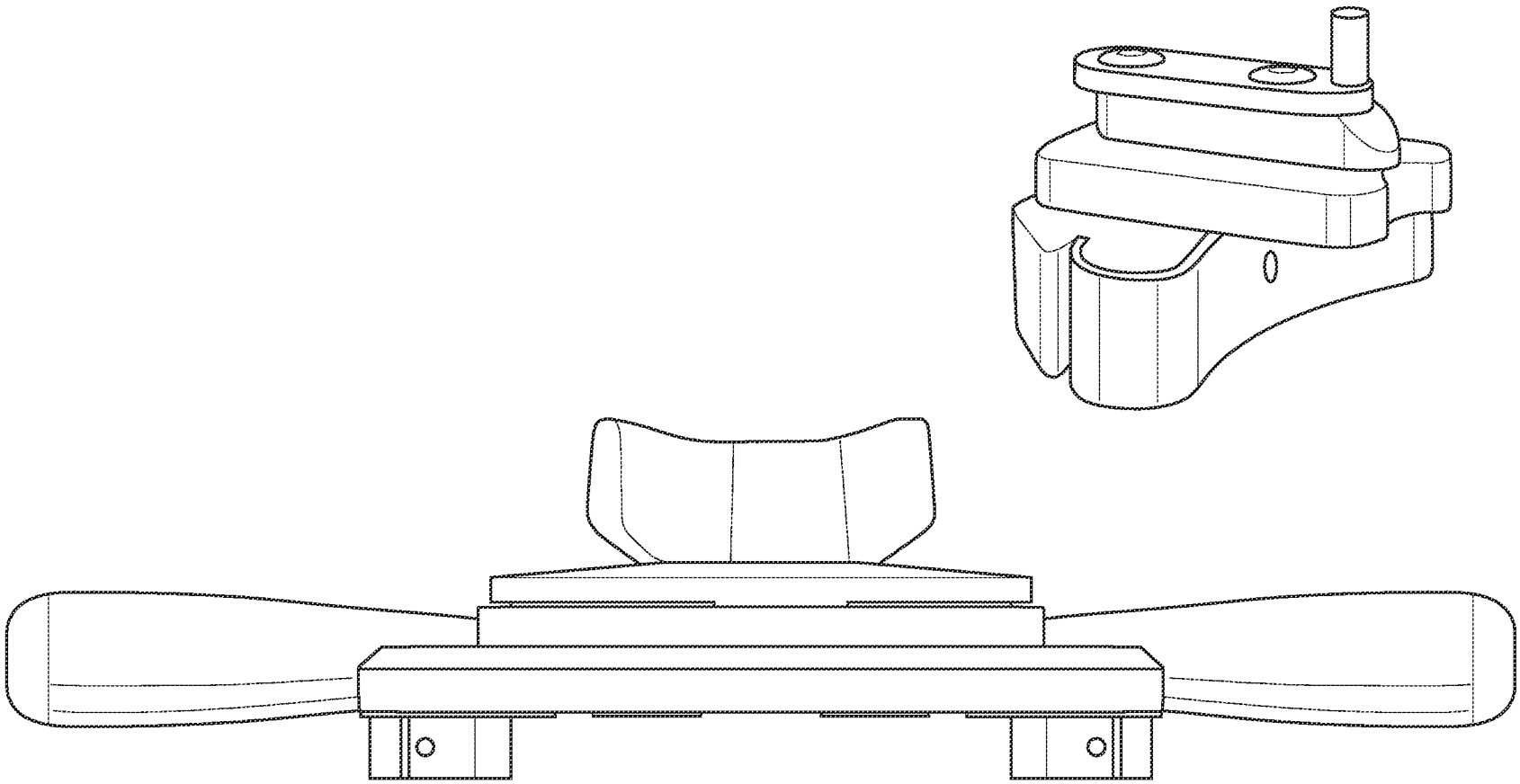
FIG. 7 is a schematic diagram showing a side view of the second exemplary device as well as a perspective view of a clamping jaw.

FIG. 7 is a schematic diagram showing a side view of the second exemplary device as well as a perspective view of a clamping jaw.

Figure 8:
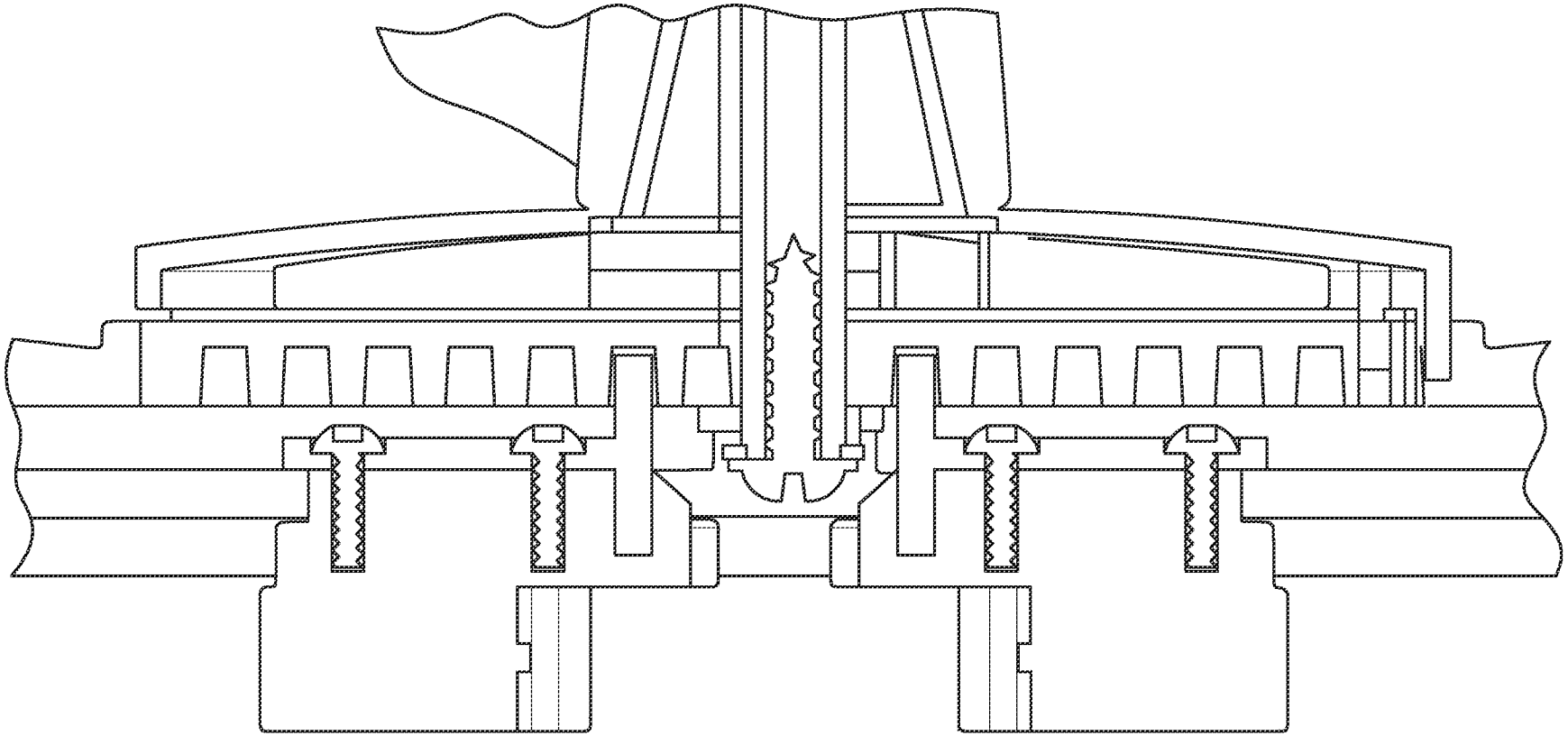
FIG. 8 is a schematic diagram showing a cross-sectional view of the clamping assembly of the second exemplary device.

FIG. 8 is a schematic diagram showing a cross-sectional view of the clamping assembly of the second exemplary device.

In order to use the devices of FIGS. 1-8, the user operates a knob on the top of the device (similar to the configuration shown in U.S. Pat. No. 7,100,473 but not shown in FIGS. 1-8 for convenience) to tighten the two clamping jaws against the screw lid. Then, the user grasps the two handles and rotates the device counterclockwise (when viewed from the top) while the container is secured (e.g., using a device for gripping a container described in U.S. Patent Application Publication No. US 2017/0283231 or U.S. Patent Application Publication No. US 2017/0284596, or perhaps even a rubber mat on which the container is placed) in order to loosen the screw lid.

In further exemplary embodiments, the two handles of the device are one-way foldable to allow for easier storage of the device such as in a kitchen utensil drawer. The device is configured so that the handles are held in the open/extended position when the device is being rotated to twist off the screw lid (i.e., in the counterclockwise direction when viewed from the top) but can fold in the opposite direction (i.e., in the clockwise direction when viewed from the top).

Figure 9:
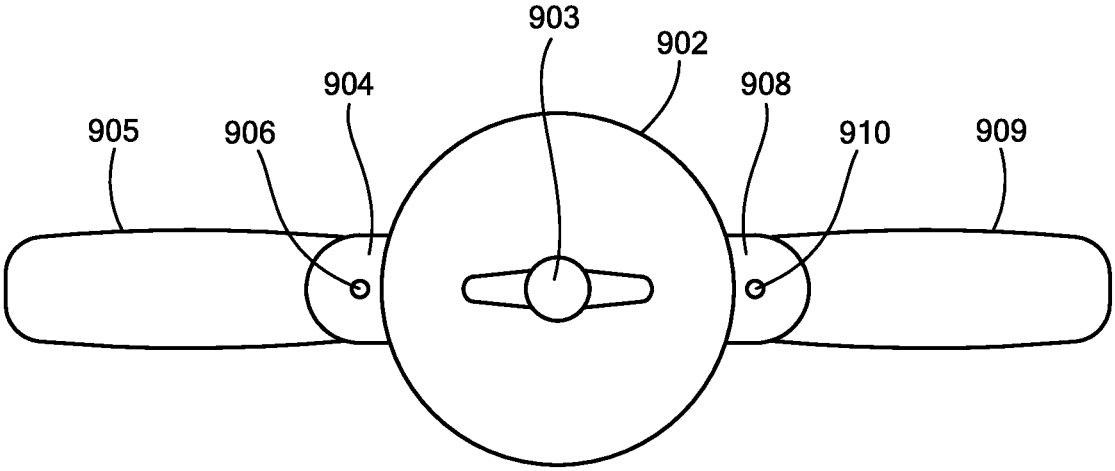
FIG. 9 is a schematic diagram showing a top view of a device with foldable handles, in accordance with one exemplary embodiment.

FIG. 9 is a schematic diagram showing a top view of a device with foldable handles, in accordance with one exemplary embodiment. The device includes a body portion 902 that includes the clamping assembly including the clamping jaws (not shown in FIG. 9, as the clamping jaws are on the underside of the body 902), a knob 903 used to move the clamping jaws, and a transmission system (not shown in FIG. 9, as the transmission system is inside the body 902) to transfer the rotational motion of the knob into linear movements of the clamping jaws. In certain exemplary embodiments, the transmission system includes a disk having one or more spiral slots, and each movable clamping jaw has a guide pin disposed within a spiral slot so as to move the clamping jaw as the disk is rotated using the knob 903. The device also includes two handles 905 and 909 that are pivotally mounted to mounting portions 904 and 908, respectively, such as by an internal pin 906 and 910, respectively. FIG. 9 shows the handles 905 and 909 in the open/extended position such as for rotating the device in the counterclockwise direction to loosen a screw lid. It should be noted that the foldable handles can be coupled to the body 902 in any way. For example, the foldable handles can be pivotally mounted to the body 902 without having distinct or separate mounting portions 904 and 908 (e.g., internally to the body 902).

Figure 10:
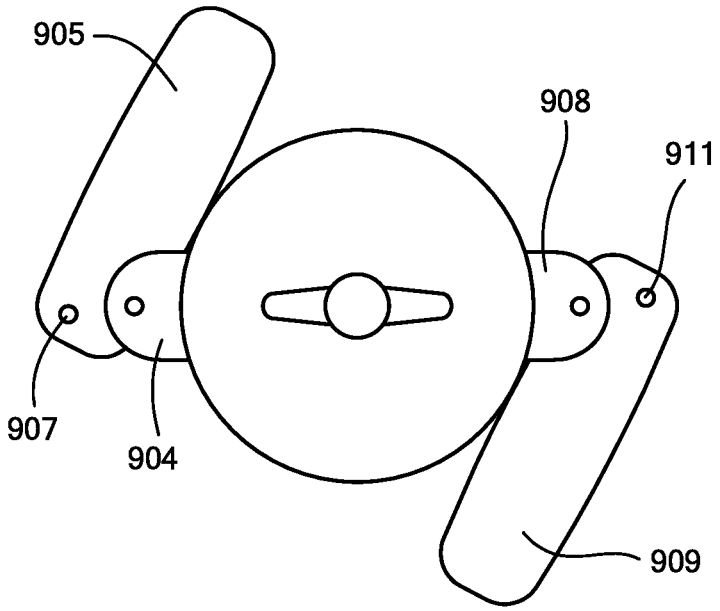
FIG. 10 is a schematic diagram showing a top view of the device of FIG. 9 with the handles folded, in accordance with one exemplary embodiment.

FIG. 10 is a schematic diagram showing a top view of the device of FIG. 9 with the handles folded, in accordance with one exemplary embodiment. In this exemplary embodiment, each handle 905 and 909 includes a pin 907 and 911, respectively, that engages with a stop in the respective mounting portion 904 and 908 when the handles 905 and 909 are in the open/extended position, although it should be noted that other mechanisms can be used to allow the handles 905 and 909 to fold in one direction and lock in the open/extended position in the other direction.

Figure 11:
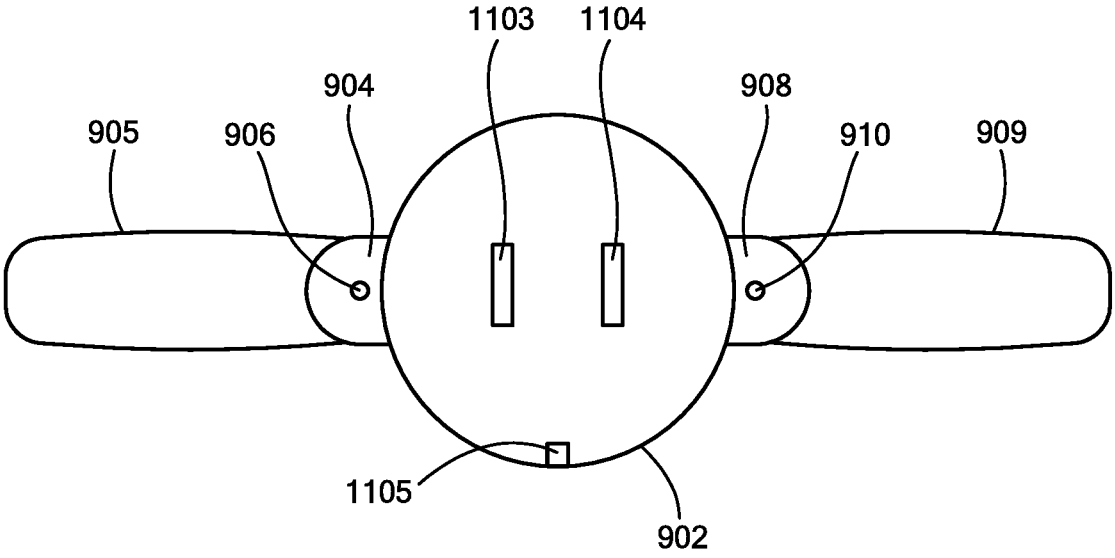
FIG. 11 is a schematic diagram showing a top view of a device with an alternative clamping assembly in which each of the two clamping jaws is coupled to a linearly-movable knob, in accordance with one exemplary embodiment.

It should be noted that the two-handled device, with or without folding handles, is not limited to use with a clamping assembly of the type described above (i.e., including a disk with one or more spiral slots that is rotated by a knob to move at least one clamping jaw) but instead can be used with any appropriate clamping assembly. For but one example of an alternative claiming assembly, FIG. 11 is a schematic diagram showing a top view of a device with an alternative clamping assembly in which each of the two clamping jaws is coupled to a linearly-movable knob 1103 and 1104, respectively, with the linearly-movable knobs 1103 and 1104 configured to be squeezed toward each other in order to clamp the clamping jaws onto the screw lid and with a spring-loaded ratcheting mechanism used to hold the clamping jaws in that position while the screw lid is being loosened. Here, each linearly-movable knob 1103/1104 is coupled to its respective clamping jaw through a linear channel and moves along the linear channel. After loosening the screw lid, the ratcheting mechanism can be released (e.g., using a push-button 1105) so that the springs move the clamping jaws outward to release the clamping jaws from the screw lid.

It also should be noted that a two-handled rotating lid opener of the types described above could be provided or sold in combination with a container securing device (e.g., devices for gripping a container described in U.S. Patent Application Publication No. US 2017/0283231 or U.S. Patent Application Publication No. US 2017/0284596, or perhaps even a rubber mat on which the container can be placed) as a kit or product grouping.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Various inventive concepts may be embodied as one or more methods, of which examples have been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Although the above discussion discloses various exemplary embodiments of the invention, it should be apparent that those skilled in the art can make various modifications that will achieve some of the advantages of the invention without departing from the true scope of the invention. Any references to the "invention" are intended to refer to exemplary embodiments of the invention and should not be construed to refer to all embodiments of the invention unless the context otherwise requires. The described embodiments are to be considered in all respects only as illustrative and not restrictive.

What is claimed is:

1. A rotating lid opener comprising:

a body having a topside and a substantially flat underside;

a clamping assembly having at least one movable clamping jaw on the underside of the body for clamping onto a screw lid of a container, a knob on the topside of the body that is rotatable relative to the body for moving the at least one movable clamping jaw, and a transmission system inside the body configured to transfer rotational movement of the knob into linear movements of the at least one movable clamping jaw along the substantially flat underside; and the body further including a pair of opposing handles to allow for two-handed use of the rotating lid opener while loosening the screw lid, wherein each handle is a foldable handle that is movable between a closed/folded position and an open/extended position.

2. A rotating lid opener according to claim 1, wherein the clamping assembly includes exactly two movable clamping jaws.

3. A rotating lid opener according to claim 1, wherein the clamping assembly includes exactly three movable clamping jaws.

4. A rotating lid opener according to claim 1, further comprising:

at least one stationary clamping jaw.

5. A rotating lid opener according to claim 1, wherein each foldable handle comprises a handle locking mechanism to hold the foldable handle in the open/extended position for operating the rotating lid opener to loosen a screw lid from a container.

6. A rotating lid opener according to claim 5, wherein the locking mechanism includes a pin.

7. A system comprising:

a rotating lid opener comprising:

a body having a topside and a substantially flat underside;

a clamping assembly having at least one movable clamping jaw on the underside of the body for clamping onto a screw lid of a container, a knob on the topside of the body that is rotatable relative to the body for moving the at least one movable clamping jaw, and a transmission system inside the body configured to transfer rotational movement of the knob into linear movements of the at least one movable clamping jaw along the substantially flat underside; and the body further including a pair of opposing handles to allow for two-handed use of the rotating lid opener while loosening the screw lid, wherein each handle is a foldable handle that is movable between a closed/folded position and an open/extended position; and a container securing device.

8. A system according to claim 7, wherein the clamping assembly includes exactly two movable clamping jaws.

9. A system according to claim 7, wherein the clamping assembly includes exactly three movable clamping jaws.

10. A system according to claim 7, further comprising:

at least one stationary clamping jaw.

11. A system according to claim 7, wherein each foldable handle comprises a handle locking mechanism to hold the foldable handle in the open/extended position for operating the rotating lid opener to loosen a screw lid from a container.

12. A system according to claim 11, wherein the locking mechanism includes a pin.

13. A system according to claim 7, wherein the container securing device comprises:

a base element configured to be placed on a surface;

a top housing rotatably secured to the base element and configured to rotate about an axis with respect to the base element, the top housing having a surface for receiving the container and a raised outer periphery, the raised outer periphery configured to provide a surface for grasping the apparatus and rotating the top housing relative to the base element;

a spiral guide element located between the base element and the top housing, the spiral guide element including a spiral groove; and a jaw member moveably secured to the top housing, the jaw member having a protrusion located within the spiral groove and configured to move along the spiral groove, rotation of the top housing in a first direction causing at least one of the jaw members to move radially inward with respect to the axis to engage the container, rotation of the top housing in a second direction causing the jaw member to move radially outward with respect to the axis to disengage the container.

14. A system according to claim 13, wherein the rotating lid opener and the container securing device are provided together as a kit.

15. A system according to claim 7, wherein the container securing device comprises a mat.

16. A system according to claim 15, wherein the rotating lid opener and the container securing device are provided together as a kit.

17. A system according to claim 7, wherein the rotating lid opener and the container securing device are provided together as a kit.

18. A method for loosening a screw lid from a container, the method comprising:

securing the container using a container securing device;

placing a rotating lid opener on a screw lid of the container, the rotating lid opener comprising:

a body having a topside and a substantially flat underside;

a clamping assembly having at least one movable clamping jaw on the underside of the body for clamping onto a screw lid of a container, a knob on the topside of the body that is rotatable relative to the body for moving the at least one movable clamping jaw, and a transmission system inside the body configured to transfer rotational movement of the knob into linear movements of the at least one movable clamping jaw along the substantially flat underside; and the body further including a pair of opposing handles to allow for two-handed use of the rotating lid opener while loosening the screw lid, wherein each handle is a foldable handle that is movable between a closed/folded position and an open/extended position;

tightening the rotating lid opener on the screw lid of the container using the knob; and using the two opposing handles of the rotating lid opener to loosen the screw lid.

* * * * *